US012173980B2

(12) United States Patent
Stolz et al.

(10) Patent No.: US 12,173,980 B2
(45) Date of Patent: Dec. 24, 2024

(54) FEEDING DEVICE, IN PARTICULAR AMMUNITION FEED OF A CANNON, HAVING A PLURALITY OF CONTAINERS FOR RECEIVING ONE OBJECT EACH, IN PARTICULAR A MILITARY ACTIVE BODY

(71) Applicant: RHEINMETALL AIR DEFENCE AG, Zurich (CH)

(72) Inventors: Gerhard Stolz, Zurich (CH); Thomas Strebel Marzano, Birmenstorf (CH)

(73) Assignee: RHEINMETALL AIR DEFENCE AG (CH)

( * ) Notice: Subject to any disclaimer, the term of this patent is extended or adjusted under 35 U.S.C. 154(b) by 0 days.

(21) Appl. No.: 17/907,204

(22) PCT Filed: Jul. 5, 2022

(86) PCT No.: PCT/EP2022/068605

§ 371 (c)(1),
(2) Date: Sep. 23, 2022

(87) PCT Pub. No.: WO2023/285210

PCT Pub. Date: Jan. 19, 2023

(65) Prior Publication Data

US 2024/0210134 A1 Jun. 27, 2024

(30) Foreign Application Priority Data

Jul. 12, 2021 (DE) ..... 102021117949.1

(51) Int. Cl.
*F41A 9/04* (2006.01)
*F41A 9/76* (2006.01)

(52) U.S. Cl.
CPC . *F41A 9/04* (2013.01); *F41A 9/76* (2013.01)

(58) Field of Classification Search
CPC ..... F41A 9/00; F41A 9/04; F41A 9/76; F41A 9/37; F41A 9/87; F41A 9/01
See application file for complete search history.

(56) References Cited

U.S. PATENT DOCUMENTS 2,365,930 A * 12/1944 Bayhi ..... B66C 1/42 294/87.1
6,679,454 B2 * 1/2004 Olsen ..... B64D 1/10 89/1.8
2003/0192992 A1 * 10/2003 Olsen ..... F41A 9/73 244/137.1
2012/0266748 A1 * 10/2012 Lindskog ..... F41A 9/76 89/45

* cited by examiner

*Primary Examiner* — Joshua E Freeman
(74) *Attorney, Agent, or Firm* — NGUYEN TARBET IP LAW

(57) ABSTRACT

A feeding device for an automatic loading system. The feeding device has a plurality of containers, each for receiving one object, and at least one actuator for opening and closing the containers. Each container has one slider and two shell segments arranged pivotably on a holder. The shell segments are pivoted back and forth in a functionally effective manner between a release position and a holding position by linear displacement of the slider. The slider is actuated by releasable contact with the actuator, and/or the slide acts on the shell segments via a control surface and a control element interacting with the control surface. The control element moves along the control surface when the slide is displaced linearly.

22 Claims, 2 Drawing Sheets

Figure 1:
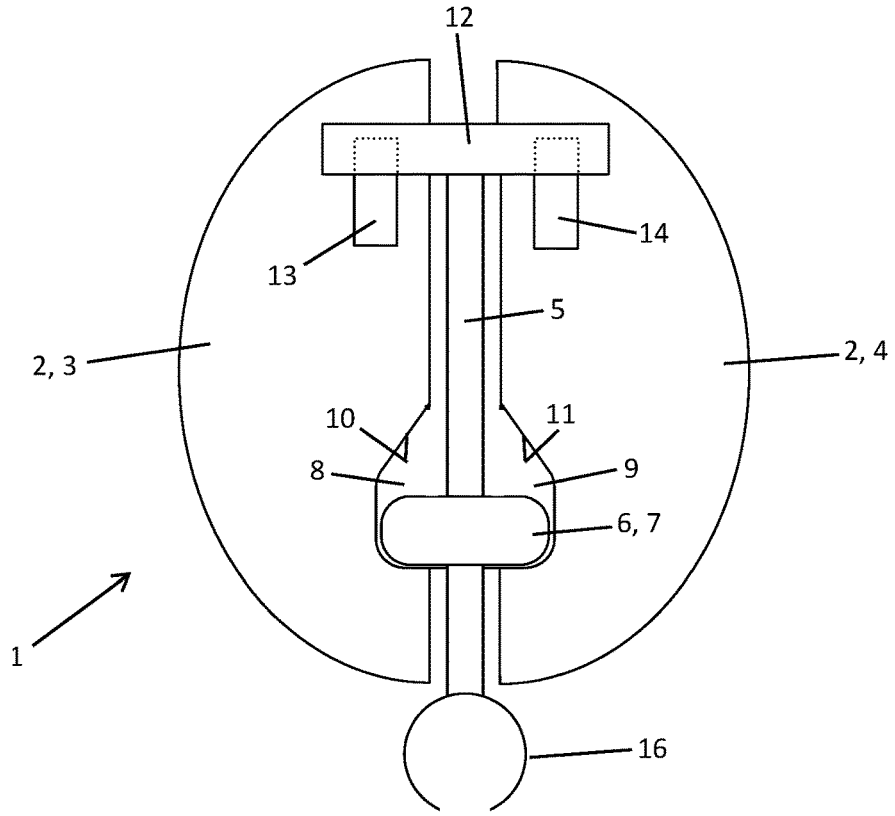

FEEDING DEVICE, IN PARTICULAR AMMUNITION FEED OF A CANNON, HAVING A PLURALITY OF CONTAINERS FOR RECEIVING ONE OBJECT EACH, IN PARTICULAR A MILITARY ACTIVE BODY

The invention relates to a feeding device with the features of the generic term of Claim 1 and a feeding device with the features of the generic term of Claim 2.

Such a feeding device serves in particular as an ammunition feed for a cannon and has a plurality of containers for receiving in each case one object, in particular a military active body, and at least one actuating means for opening and closing the containers. The containers each having two shell segments arranged pivotably on a holder and in each case one slider, making it possible for the shell segments to be pivoted back and forth in a functionally effective manner between a release position and a holding position by linear displacement of the slider, it being possible for the slider to be actuated by the actuating means.

Such feeding devices are used, in particular, for loading and unloading from a container in the form of an ammunition cup in an automatic loading system for guns. In this connection, the invention also relates to a method for loading or unloading a gun. The invention also relates to a feeding device for opening and closing ammunition cups in an automatic loading system, in particular for tank guns.

The magazines of, for example, armoured vehicles have a bucket chain or a belt conveyor on which a plurality of containers, the so-called buckets, for receiving cartridges are arranged. The containers are also referred to as ammunition loading containers. With the aid of the bucket chain or the belt conveyor, the cartridges are conveyed to the loading opening of a cannon or to a feeder of a cannon. In the following, magazines are also referred to as ammunition feed. The terms cartridge and ammunition are used synonymously. Conventional cartridges have a sleeve with a sleeve diameter for receiving a propellant charge. The sleeve is adjoined by a projectile. In the event of a shot, the propellant charge is ignited and the projectile is fired through a weapon barrel. In prior art holding flaps for fixing the ammunition in the form of pliers, holding jaws, clamps and grippers are known.

U.S. Pat. No. 2003 0192 992 A1 discloses a discharge mechanism for cylindrical sonar buoys in which the individual sonar buoys are transported in buckets from a magazine to the discharge position. The individual cups are formed from two half-shells. The half-shells are connected to one another in an articulated manner via an axis at a longitudinal edge region in the centre of the cup, so that the opposite free longitudinal edge regions can pivot apart from one another in order to release the sonar buoy. During transport, the half-shells are held closed by a linkage which engages on the outside at the centre of the half-shells. The shaft passes through a slider. A linear actuator is provided as an actuating means, which is fastened to the slider. The actuator has a cylinder and a piston that can be displaced therein. The slider forms the end piece of the piston. The linkage engages the outside of the cylinder. During ejection, the cups are opened by a linear movement of the piston and thus of the slider by the central actuator. The sonar buoys are ejected radially from the buckets. A disadvantage of this approach is the non-detachable connection of the actuator to the individual cups, which limits the design of the automatic loader to a rotation about a central point of rotation. This requires a relatively large amount of space.

An automatic loading device for firearms is known from DE 30 46 642 A1. The ammunition is stored in two magazines. Each magazine has three layers arranged one above the other, each with six cartridges. The cartridges of the lowermost layer are fed to a loading tube by a transport mechanism. The cartridges arranged in the two upper layers lie in cups. The cups are designed as half-shells, the two halves having a common pivot axis. The half shells can be opened by means of a common lever mechanism in order to fill an underlying layer with ammunition. The ammunition is then supplied to the weapon via a transport mechanism. A disadvantage of this approach is that the ammunition is not protected by the cups during the transport process and all cups of a layer are opened/closed simultaneously. In addition, it is not possible to return the ammunition with this structure.

The invention is based on the task of providing a feeding device, in particular a compact ammunition feeding device for an automatic loading system, which allows individual unloading and/or loading of the ammunition.

This task underlying the invention is now solved by a feeding device having the features of patent claim 1. It is particularly advantageous in this case according to the invention that the slider can be actuated by means of a releasable contact with the actuating means. This has the advantage that an actuating means need not be present for each container, but rather more containers can be provided as actuating means. It is conceivable that, for example, an actuating means is arranged in each case at an unloading point and at a loading point, and the containers are transported, for example, via a chain conveyor or a belt conveyor to the unloading point or the loading point. Furthermore, only one central actuating means can be present. As a result, the feeding device has a more compact construction. A detachable connection between the container and a central actuating means or two separate actuating means is possible at the loading point and at the unloading point. The fact that the actuating means can optionally be brought into releasable contact with the slider, individual loading of the containers can take place. For example, different types of ammunition can thus be mixed and loaded into the magazine, namely the corresponding bucket chain. In this case, each container has a separate opening mechanism which allows the individual opening and closing of the cups.

The use of such a feeding device is particularly advantageous for the opening and closing mechanism for ammunition cups of an automatic loading system, in particular for tank guns. Each container has pivotable shell segments and one slider each. The shell segments can be swivelled back and forth between a release and a holding position in a functionally effective manner by linear displacement of the slider. The slider is preferably guided in a linearly displaceable manner on a holder.

The task is solved by a feeding device with the features of patent claim 2, wherein the slider acts on the tray segments via a control surface and a control element cooperating with the control surface, wherein upon a linear displacement of the slider the control element moves along the control surface. This has the advantage that the feeding device can be designed to be more compact. No additional linkage is necessary which has to be attached to the shell segments, but the control surface can be formed on the shell segments or on the slider and the control element can be correspondingly fastened or formed on the other component, namely on the slider or on the shell segments.

The shell segments preferably each have a recess, the wall of the recess forming the control surfaces. The slider can now have a control element which projects laterally into the recesses and which, in the case of a linear displacement, forces the shell segments apart.

In order to securely hold the contents of the containers, in particular the cartridges of the ammunition feeding device, even when heavy ammunition is used, for example a large calibre of more than 120 mm, it is particularly advantageous if the shell segments each have a securing element, the slider, in the holding position, holding the securing elements in a preferably form-fitting or force-fitting connection, the connection being releasable by a movement of the slider relative to the shell segments. As a result, the containers are secured by an element of the slider which directly connects the two shell segments, preferably avoiding the effect of leverage by suitable positioning of the securing elements. The distance of the securing elements from the pivot points is preferably greater than a quarter of the diameter of the container, so that the smallest possible holding forces are sufficient to keep the containers closed.

For example, the slider can have a T-shaped end piece, the T-shaped end piece engaging under two retaining lugs as securing elements during retraction, the retaining lugs being arranged on the shell segments. As a result, these holding noses can be clamped or held in a form-fitting manner, so that the shell segments can no longer be pivoted with respect to one another.

Each of the shell segments is in each case pivotable about a pivot point, that is to say there are two pivot points here, one for each shell segment, the shell segments preferably being arranged rotatable in each case on a holder. The pivot points can be formed by pins, whereby the shell segments having corresponding receptacles through which the pins pass and thus a rotatable arrangement of the shell segments on the holder is realized. The pivotable shell segments are secured by the securing elements. As a result of the movement of the slider, the slider is first released from the securing elements. Thereafter, the slider acts on the shell segments in such a way that the shell segments are pivoted apart by the further movement of the slider.

In a particularly preferred refinement, the shell segments are designed as semi-cylindrical half shells, the containers forming an essentially cylindrical full shell in the closed state. This configuration is particularly advantageous if essentially cylindrical objects, for example cartridges, are to be arranged in the containers.

In a preferred embodiment of the shell segments, the shell segments form a cylindrical full shell. The cylindrical full shell has a longitudinal axis and a transverse axis, the transverse axis extending through the centre of a cross section of the cylindrical full shell. The transverse axis divides the cross section into two halves, the at least one fulcrum, in particular the two fulcrums, being positioned in a different half than the attachment point or points of the securing element. The at least one fulcrum of the shell segments is located in one half and the securing element is located in the other half. In this way, a reliable closure of the cup can be realized, which has a low risk of unintentional opening due to stronger lever forces. The distance between the securing elements and the fulcrums is preferably greater than half a radius or a quarter of the diameter of the cylindrical full shell.

In a preferred embodiment, the shell segments have securing elements made of a preferably metallic material for fixing the ammunition in the cup. In a preferred embodiment, the shell segments CFRP and/or GFRP and/or a metallic material and all other components of the feeding device comprise a metallic material.

The slider and the actuating means can preferably be releasably connected to one another via a coupling element. The coupling element preferably permits a selectively active connection between the slider and the actuating means. In the coupled state, both pulling and pushing movements can preferably be transmitted to the slider via the coupling element by actuating means. A selectively active coupling element is understood here to mean a coupling element which can be activated or deactivated by an actuator. The selectively active coupling element can be activated, for example, as a function of a signal from a control unit and corresponding control software. A passive coupling element is to be understood as meaning a coupling element which automatically establishes the connection between the interface and the connecting element when the connecting element comes into contact with the interface, for example by means of a magnetic connection, Velcro elements and/or hook/eye connections.

In one embodiment, the coupling element has Velcro elements. In a further embodiment, the coupling element has magnetic elements. In one embodiment, the coupling element has a mechanical coupling. These embodiments of the coupling serve to open the container in the case of positive force transmission and to close the container in the case of negative force transmission and to disconnect the connection after the closing end of the container.

In a preferred refinement, the coupling element has two holding jaws which can be pivoted with respect to one another, it being possible for the holding jaws optionally to engage around an end piece of the actuating means. In the closed state of the holding jaws, i.e. when the holding jaws engage around the end piece, a form-fitting connection is realized. When the holding jaws pivot apart, they release the end piece and the actuating means can be retracted. The holding jaws can be closed by displacement in a guide.

The method for loading or unloading a gun with a feeding device is carried out by the following steps:

a. Contacting the slider with the actuating means,
b. Pivoting the shell segments apart by force transmission from the actuating means to the slider, linear displacement of the slider and/or transmission of a torque to the shell segments,
c. Loading or unloading the container with ammunition;
d. Pivoting the shell segments together by linear Transmission of force of the slider, preferably radially to the longitudinal axis of the container, and/or by the transmission of a torque to the shell segments,
e. Release of the contact between the actuating means and the slider.

In step d), the shell segments can be pivoted together either by retracting the slider and the interaction with corresponding control surfaces and the control element, or alternatively, the shell segments can be pivoted together by at least one spring when the slider is retracted, a torque acting on the shell segments by the at least one spring.

If securing elements are present, a release of the securing elements before the pivoting apart is carried out by a force transmission of the slider, preferably by a linear force transmission radially to the longitudinal axis of the container, or the transmission of a torque, and closing of the securing elements after the pivoting together is carried out by a linear force transmission of the slider or the transmission of a torque. The torque for releasing and/or closing can be transmitted, for example, by pivoting a locking pawl surrounding the respective securing element. The locking pawl can be attached to the holder or to the slider and is preferably likewise actuated by the actuating means.

In one embodiment, the connections of the slider to the securing elements are released by retracting the slider alone. In another embodiment, pivotable components, for example detent pawls, can be mounted on the slider, which can be released from the securing elements by the transmission of a torque.

The feeding device and the method can be used for ammunition and for other military active bodies such as mortar shells, rockets, mines or torpedoes. Furthermore, use for other essentially cylindrical objects such as sonar buoys or unmanned flying objects is possible.

The actuating means can be designed as a linearly acting actuator. Alternatively, the actuating means can be designed as a control cam which displaces the slider linearly when the containers are moved relative to the control cam or the control cam is moved relative to the containers. Alternatively, the actuating means can be actuated by a torque. The actuating means can be, for example, a lever coupled to the slider, a spindle drive or a toothed rack driven by a motor.

Figure 2:
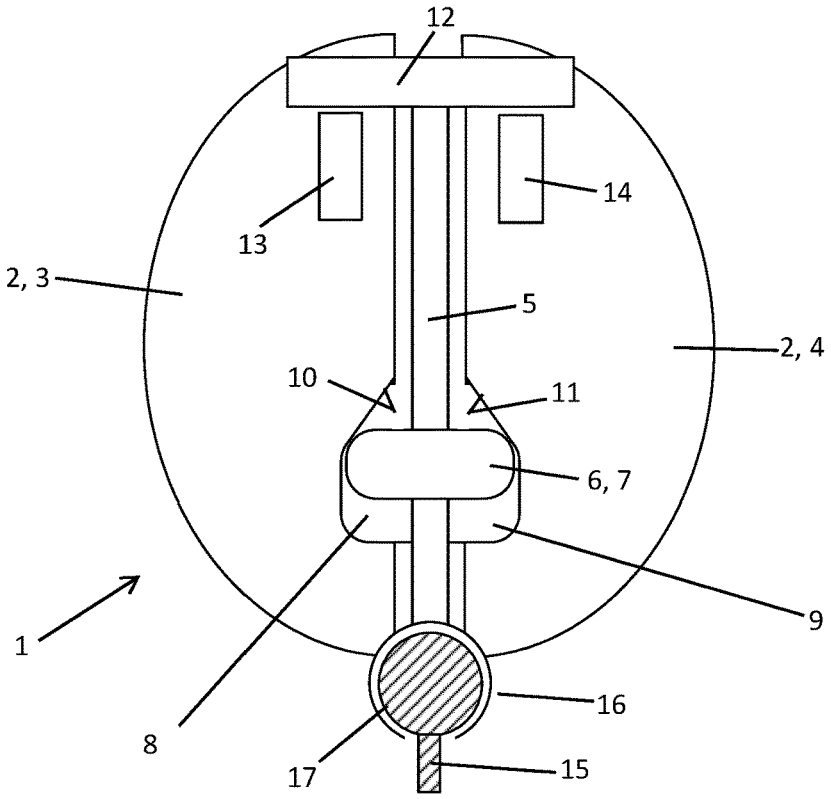
Figure 3:
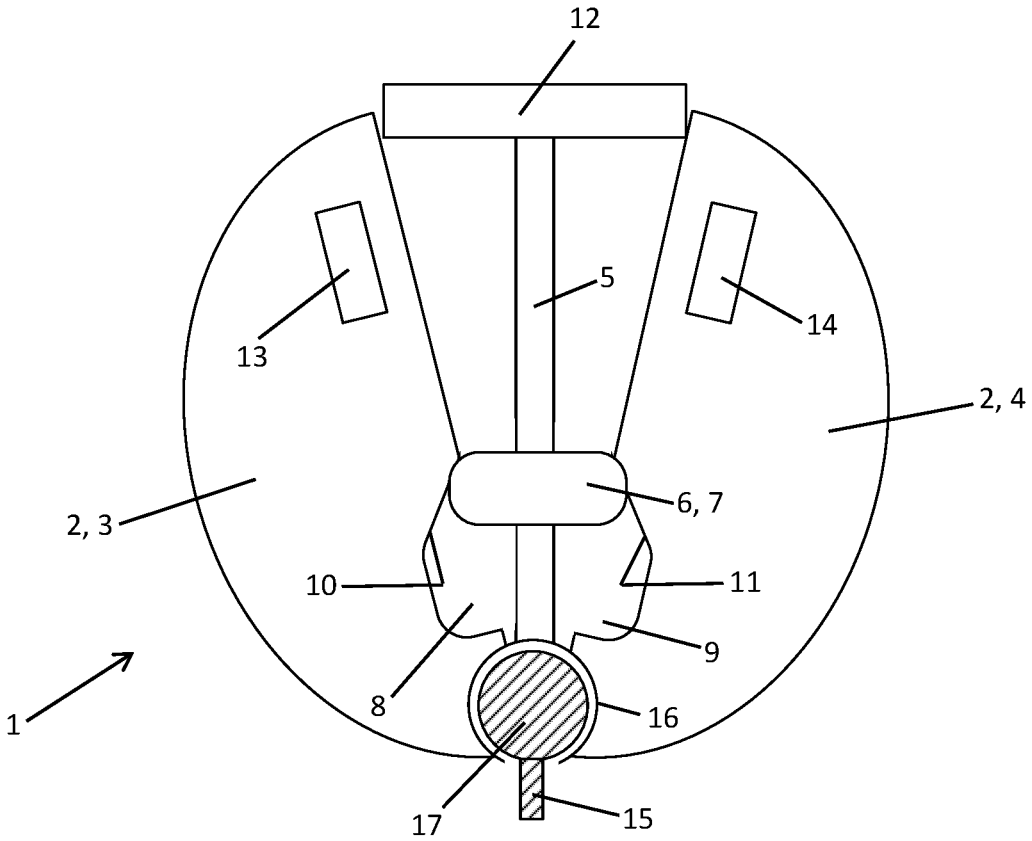

There are now a large number of possibilities for embodying and developing the invention. For this purpose, reference can first be made to the claims subordinate to Claim 1. In the following, a preferred embodiment of the invention is explained in more detail with reference to the drawing and the accompanying description. The following is shown in the drawing:

FIG. 1 shows, in a schematic side view, a part of an ammunition feeding with a container, the container being shown in a closed and locked state, FIG. 2 shows a schematic side view of the container in a closed but unlocked state, and FIG. 3 shows a schematic side view of the container in an open state.

In FIG. 1 to 3, an ammunition feeder 1, namely a container 2, can be seen, wherein the container 2 is essentially formed by two shell segments 3, 4. The shell segments 3, 4, are designed as semi-cylindrical shells. The shell segments 3, 4 can each be swivelled back and forth around a pivot point between a closed position (cf. FIGS. 1 and 2) and an open position (cf. FIG. 3). Military active bodies such as cartridges (not shown) can be arranged inside the container 2.

The shell segments 3, 4, together form essentially a fully cylindrical container 2. A slider 5 is now provided for opening and closing the container 2. The slider 5 is guided linearly on a mounting (not shown). The slider 5 is linearly displaceable. In the locked state, the slider 5 is arranged in the position shown in FIG. 1. The slider 5 has a control element 6 in the form of a crossbar, the crossbar or the control element 6 engaging in laterally arranged recesses 8, 9 in the shell segments 3, 4 respectively. Control surfaces 10, 11 extending obliquely to the direction of movement of slider 5 are formed in the recesses 8, 9. When the slider 5 in FIG. 1 is now moved upwards, the slider 5 in the position shown in FIG. 2 comes into contact with the control surfaces 10, 11, which results in a torque, which finally forces the shell segments 3, 4 apart and thus opens the container 2.

In the position shown in FIG. 1, the shell segments 3, 4 are held on the shell segments 3, 4 by two securing elements 13, 14 in the form of holding noses 13, 14. For this purpose, a securing strip 12 is formed on the slider 5, which engages over the holding noses 13, 14 and thus realizes a clamping connection or a positive-locking connection. For example, in order to realize a positive connection, corresponding recesses could be provided on the securing strip 12, in which the retaining lugs 13, 14 engage in the locked position. The retaining lugs 13, 14 are formed integrally on the shell segments 3, 4 or are attached to or connected with the shell segments 3, 4. The securing strip 12 is formed or attached here to one end of the slider 5. However, the securing strip 12 or a corresponding securing device can also be arranged in a central position. However, it is advantageous if the securing strip 12 and the retaining lugs 13, 14 or the corresponding securing elements 13, 14 are located as far as possible from the pivot points, the pivot points here being located in a lower half of the shell segments 3, 4 and the retaining lugs 13, 14 being located in an upper half of the shell segments 3, 4. The fact that the distance from the securing elements 13, 14 to the pivot points is as large as possible, especially greater than half the radius or quarter the diameter of container 2, ensures that the shell segments 3, 4 are held together securely, even if a large-caliber ammunition, for example with a diameter of more than 120 mm, is used.

Shown is a coupling element 16 in the form of an essentially cylindrical receptacle into which a head 17 of the actuating means 15 can engage. It is conceivable for the coupling element 16 to be formed by two pivotable holding jaws which, in the closed state (cf. FIG. 1), are held together by a guide on both sides and, when they have been retracted into the release position, the actuating means 15 can be pivoted apart as soon as they have left the guide, so that the actuating means 15 can be uncoupled from the slider.

In a preferred embodiment, the slider 5 and the actuating means 15 can be connected to each other in a releasable manner via a non-positive and/or positive connection, so that both tensile and compressive forces can be transmitted from the actuating means 15 to the slider 5.

In an alternative embodiment, it is possible that the slider 5 is pressed into the closed, locked position by springs and, for example, only the opening and unlocking of the container 2 is realized by the actuating means 15, i.e. the actuating means 15 transmits only compressive forces but no tensile forces. If only compressive forces are transmitted, it may also be possible to dispense with a coupling, since the slider 5 only has to be displaced along the guide by contact with the actuating means 15, without tensile forces having to be transmitted to the slide 5.

This ammunition guide 1 is used in particular in a belt conveyor or a chain conveyor, a corresponding actuator, i.e. a corresponding actuating means 15, being present in each case at a loading and an unloading point. Due to the fact that the actuating means 15 can be uncoupled from the slider 5, it is possible, on the one hand, to selectively load and open individual containers 2 with, for example, different types of ammunition, and, on the other hand, a particularly space-saving construction is realized.

The disadvantages mentioned at the outset are therefore avoided and corresponding advantages are achieved.

LIST OF REFERENCE NUMERALS

1 Ammunition feeder
2 Container
3 Shell segment
4 Shell segment
5 Slider
6 Control element
7 Crossbars
8 recess
9 recess
10 Control area
11 Control area
12 Safety bar

13 Retaining lugs/safety elements
14 Retaining lugs/safety elements
15 Actuating means
16 Coupling element/receptacle
17 Head

The invention claimed is:

1. Feeding device having a plurality of containers (2) for receiving in each case an object, and having at least one actuating means (15) for opening and closing the containers (2), wherein the containers (2) each have two shell segments (3, 4) arranged pivotably on a holder and in each case a slider (5), wherein the shell segments (3, 4) are pivoted back and forth in a functionally effective manner between a release position and a holding position by linear displacement of the slider (5), wherein the slider (5) is actuated by the actuating means (15), characterized in that the slider (5) is actuated by means of a releasable contact with the actuating means (15).

2. Feeding device according to claim 1, characterized in that the shell segments (3, 4) each have a recess, one wall of the recess (8, 9) forming the control surfaces (10, 11), the slider (5) having a control element (6) projecting laterally into the recesses (8, 9).

3. Feeding device according to claim 1, characterized in that the shell segments (3, 4) are designed as semi-cylindrical half shells, the containers (2) forming a substantially cylindrical full shell in the closed state.

4. Feeding device according to claim 1, characterized in that the shell segments (3, 4) are each pivoted about a pivot point.

5. Feeding device according to claim 1, characterized in that the slider (5) and the actuating means (15) is releasably connected to one another via a coupling element (15).

6. Feeding device according to claim 1, characterized in that the coupling element (16) is controlled by means of an actuator in order to open and close the connection.

7. Feeding device according to claim 1, characterized in that the coupling element (16) has two pivotable holding jaws for opening and closing the connection, the holding jaws in a holding position engaging around an end piece of the actuating means (15) and in a release position of the holding jaws no longer engaging around the end piece and the end piece being retractable in order to release the connection.

8. Feeding device according to claim 1, characterized in that the shell segments (3, 4) each have a securing element (13, 14), the slider (5) holding the securing elements (13, 14) in a form-locking or force-locking connection in the holding position, the connection being releasable by a movement of the slider (5) relative to the shell segments (3, 4).

9. Feeding device according claim 1, characterised in that the distance of the securing elements (13, 14) from the pivot points is greater than a quarter of the diameter of the container (2).

10. Feeding device according to claim 1, characterised in that the feeding device is an ammunition feed (1) of a gun.

11. Feeding device according to claim 1, characterised in that the containers (2) are formed for receiving in each case a military active body.

12. Method for loading and a gun with the feeding device according to claim 1, with the steps of a. Contacting the slider with the actuating means,
b. Pivoting the shell segments apart by transmission of force from the actuating means to the slider, linear displacement of the slider and/or transmission of a torque to the shell segments,
c. Loading or unloading the container with ammunition;
d. Pivoting the shell segments together by linear force transmission of the slider, wherein the shell segments are pivoted radially to the longitudinal axis of the container, and/or by the transmission of a torque to the shell segments, and
e. Release of the contact between the actuating means and the slider.

13. Method according to claim 12, characterized by a release of the securing elements before the pivoting apart by force transmission of the slider, and closing of the securing element after the pivoting together by the linear force transmission of the slider or the transmission of a torque.

14. Feeding device having a plurality of containers (2) for receiving in each case an object, and having at least one actuating means (15) for opening and closing the containers (2), the containers (2) each having two shell segments (3, 4) arranged pivotably on a holder and in each case a slider (5), the shell segments (3, 4) being capable of being pivoted back and forth between a release position and a holding position in a functionally effective manner by linear displacement of the slider (5), it being possible for the slider (5) to be actuated by the actuating means (15), characterized in that the slider (5) acts on the shell segments (3, 4) via a control surface (10, 11) and a control element (6) which interacts with the control surface (10, 11), the control element (6) moving along the control surface (10, 11) in the event of a linear displacement of the slider (5).

15. Feeding device according to claim 14, characterized in that the shell segments (3, 4) each have a recess, one wall of the recess (8, 9) forming the control surfaces (10, 11), the slider (5) having a control element (6) projecting laterally into the recesses (8, 9).

16. Feeding device according to claim 14, characterized in that the shell segments (3, 4) are designed as semi-cylindrical half shells, the containers (2) forming a substantially cylindrical full shell in the closed state.

17. Feeding device according to claim 14, characterized in that the shell segments (3, 4) are each pivoted about a pivot point.

18. Feeding device according to claim 14, characterized in that the slider (5) and the actuating means (15) are releasably connected to one another via a coupling element (15).

19. Feeding device according to claim 14, characterized in that the coupling element (16) is controlled by means of an actuator in order to open and close the connection.

20. Feeding device according to claim 14, characterized in that the coupling element (16) has two pivotable holding jaws for opening and closing the connection, the holding jaws in a holding position engaging around an end piece of the actuating means (15) and in a release position of the holding jaws no longer engaging around the end piece and the end piece being retractable in order to release the connection.

21. Feeding device according to claim 14, characterized in that the shell segments (3, 4) each have a securing element (13, 14), the slider (5) holding the securing elements (13, 14) in a form-locking or force-locking connection in the holding position, the connection being releasable by a movement of the slider (5) relative to the shell segments (3, 4).

22. Feeding device according claim 14, characterised in that the distance of the securing elements (13, 14) from the pivot points is greater than a quarter of the diameter of the container (2).

* * * * *